US006401574B1

(12) United States Patent
Myers

(10) Patent No.: US 6,401,574 B1
(45) Date of Patent: Jun. 11, 2002

(54) OIL FILTER REMOVAL AND INSTALLATION DEVICE

(76) Inventor: Jacob L. Myers, 7090 Jackson Dr., Seven Valleys, PA (US) 17360

( * ) Notice: Subject to any disclaimer, the term of this patent is extended or adjusted under 35 U.S.C. 154(b) by 0 days.

(21) Appl. No.: 09/637,102

(22) Filed: Aug. 10, 2000

(51) Int. Cl.[7] ..... B25B 13/06
(52) U.S. Cl. ..... 81/121.1; 7/100
(58) Field of Search ..... 81/120, 121.1, 81/124.1, 124.2, 124.7, 3.08, 3.4; 7/100, 138

(56) References Cited

U.S. PATENT DOCUMENTS

| | | | | | |
|---|---|---|---|---|---|
| 671,789 | A | * | 4/1901 | Borgeson | 81/124.1 |
| 2,746,330 | A | * | 5/1956 | Pfetzing | 81/124.7 |
| 3,385,141 | A | * | 5/1968 | Norman | 81/120 |
| 3,853,026 | A | | 12/1974 | Rhodes | |
| 4,266,452 | A | | 5/1981 | Crist | |
| 4,964,330 | A | | 10/1990 | Swinney et al. | |
| 5,154,102 | A | | 10/1992 | Becker | |
| 5,259,426 | A | * | 11/1993 | Burleigh et al. | 81/121.1 |
| 5,271,299 | A | | 12/1993 | Wadsworth | |
| 5,307,712 | A | | 5/1994 | Pratt | |
| 5,896,785 | A | * | 4/1999 | Shaw | 81/121.1 |
| 5,924,342 | A | * | 7/1999 | Chou | 81/121.1 |

* cited by examiner

*Primary Examiner*—D. S. Meislin
(74) *Attorney, Agent, or Firm*—Milord Keshishzadeh, Esq.; Milord & Associates

(57) ABSTRACT

An oil filter installation and removal device is provided to remove an oil filter canister from an engine whereby any leaking oil is captured thereby. The device is substantially cup shaped having an open end and a closed end thereby forming a reservoir therein, wherein a handle extends from said closed end. An attaching member having a small diameter than the open end is maintained within the open end by equidistantly spaced binding means which provide an aperture therebetween. Attaching member receives a bottom end of a canister therein and when torque is applied to the handle it removes the canister from the engine block. Any excess oil which escapes passes through the apertures and is captured within the reservoir.

18 Claims, 3 Drawing Sheets

OIL FILTER REMOVAL AND INSTALLATION DEVICE

FIELD OF THE INVENTION

This invention relates to tools in general and, more specifically, to a tool for removing oil filters from internal combustion engines.

BACKGROUND OF THE INVENTION

Canister-type oil filters that are currently in use for mounting on engines have a common external configuration. The filters have a cylindrical body portion which is attached to a second portion that has a plurality of generally flat sides and may be polygonal in cross section. The cylindrical portion is threaded at an end opposing the point of attachment between the cylindrical portion and the second portion. The threaded portion engages a corresponding threaded portion on the engine and is thereby mounted thereon.

In order to remove the oil filter from the engine, several devices have been used with certain drawbacks. U.S. Pat. No. 5,154,102 to Becker discloses a tool having spikes that are driven into the body of the oil filter to provide for the application of torque. However, the puncturing of the body of the oil filter will result in the unwanted discharge of hot and dirty oil unto the clothing or body of the user and can also contaminate the work area.

U.S. Pat. No. 4,964,330 to Swinney et al. (hereinafter "Swinney") discloses an oil filter accessory that is attached to the oil filter canister through a plurality of cumbersome methods. However, Swinney fails to disclose the capturing of escaping oil during the removal of the oil filter from the engine. Furthermore, Swinney only provides removal of the canister by a hand of a user and is not able to accommodate any removal tools which are necessary in removing oil filters that have become stuck.

U.S. Pat. No. 5,307,712 to Pratt discloses a tool for installing and removing filters that uses an annular band connected with a U-shaped metal strip that serves as a handle. The annular band may fail to apply sufficient frictional engagement in order to allow the application of torque to the canister. Furthermore, because oil will be escaping onto the outer surface of the canister, the frictional force between the band and the canister will once again be reduced and may result in failure of the tool.

U.S. Pat. No. 3,853,026 to Rhodes discloses an oil filter removing tool that must be used in combination with a wrench only. Although Rhodes discloses capturing of escaping oil, it admits that the tool does not capture all of the oil.

U.S. Pat. No. 4,266,452 to Crist provides an oil filter wrench that is able to capture some escaping oil. However, because the entire canister is received within the receiving portion of the wrench, the amount of oil that may be captured is limited. Furthermore, the removal method of Crist mandates that both hands of a user be used in order to maintain the tool in place and to apply force thereto which is not possible in the tightly spaced location of the oil filter within.

U.S. Pat. No. 5,271,299 to Wadsworth provides an oil filter wrench with an oil catching boot. However, the boot is rather large and bulky and cannot be used within the confined space surrounding an oil filter canister within a vehicle's engine. Furthermore, Wadsworth is only operational with wrenches and cannot be manipulated directly with human hands.

The prior art does not address the need for an apparatus that satisfactorily removes an oil filter from its mounting on an engine whereby the escaping oil is captured within a cavity of sufficient size. Therefore, there remains a long standing and continuing need for an advance in the art of oil filter removal and methods of use thereof that is simpler in both design and use, is more economical, efficient in its construction and use, and eliminates the failures of the prior art.

SUMMARY OF THE INVENTION

Accordingly, it is a general object of the present invention to overcome the disadvantages of the prior art.

In particular, it is an object of the present invention to provide an oil filter removal and installation device that may be operated by human hands.

It is another object of the present invention to provide an oil filter removal and installation device that may be operated by a tool such as a wrench or a screw-driver.

It is another object of the present invention to provide an oil filter removal and installation device that is easy to manufacture and use.

It is another object of the present invention to provide an oil filter removal and installation device that is compact and can be used within the limited space around a vehicles engine.

It is another object of the present invention to provide an oil filter removal and installation device that has a disengagement device for removing the oil filter canister after removal thereof.

It is yet another object of the present invention to provide an oil filter removal and installation device that may be integrally molded in a one-piece construction.

In keeping with the principles of the present invention, a unique oil filter removal and installation device is provided that is substantially cup shaped and has a peripheral contiguous wall that defines an open end and a closed end defined by a bottom. A handle extends from the bottom, closed end in a direction that is distal to the open end and is adapted to accommodate a hand of a user. A cavity may also be provided within the handle that is adapted to receive a torque applying tool such as, but not limited to, a wrench or a screw-driver. A reservoir is thus defined by the wall and the bottom of the device for capturing any excess leaking oil.

An attaching member that has a peripherally contiguous barrier defines an opening therein that is axially aligned with the open end of the device. The attaching member is adapted to have a smaller diameter than the open end as defined by the wall. At least a binding means extends from the wall and binds to the barrier of the attaching member to maintain the same within the open end. At least an aperture is defined within the binding means and between the wall and the barrier such that any excess oil passes through the aperture and into the reservoir.

Such stated objects and advantages of the invention are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the invention. In the drawings, wherein similar reference characters denote similar elements throughout the several views.

DETAILED DESCRIPTION OF THE INVENTION

Figure 1:
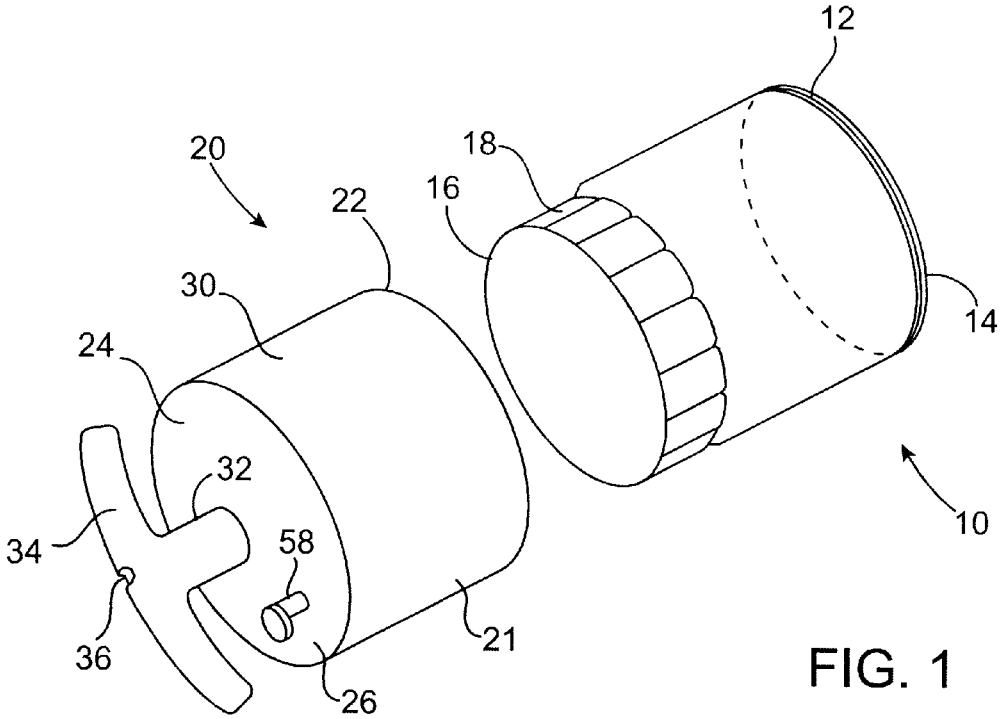
FIG. 1 is a perspective view of the oil filter removal and installation device and the oil filter canister.

Referring now to FIG. 1, therein is shown an oil filter canister 10 for use on an internal combustion engine. Canister 10 is generally manufactured in the form as shown wherein a first end 12 has a threaded lip 14 adapted to attach to an internal combustion engine (not shown). Canister 10 is generally cylindrical in shape but has a second end 16 that is distal to first end 12 and is polygonal in cross section, having a plurality of flat sides 18. Opposing flat sides 18 usually have a diameter that is less than the diameter of the cylindrical portion of canister 10.

Figure 2:
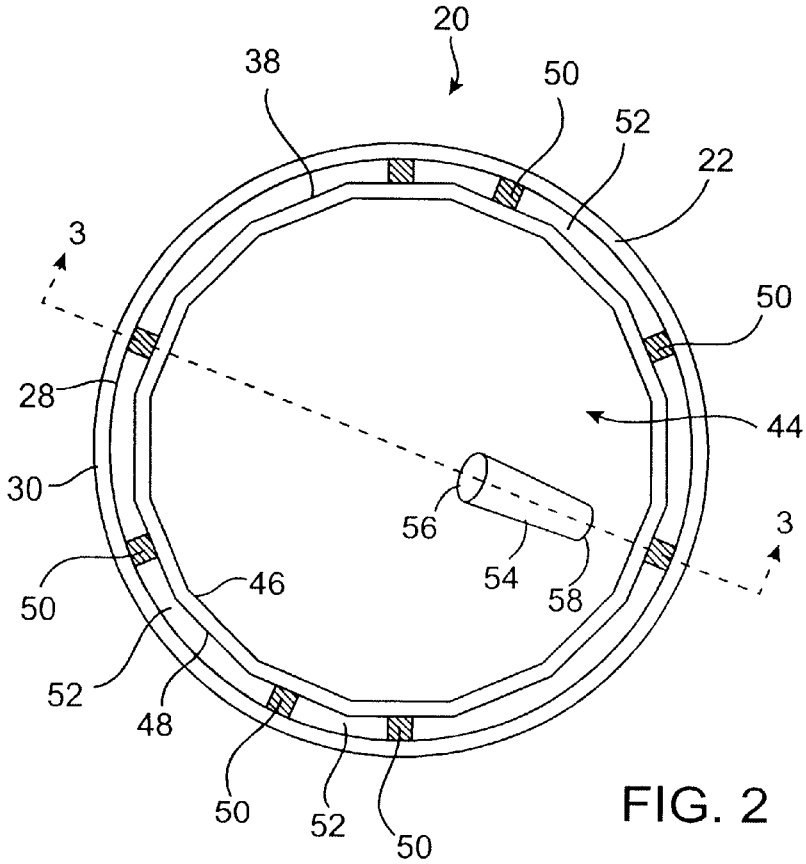
FIG. 2 is a top perspective view of the oil filter removal and installation device.
Figure 3:
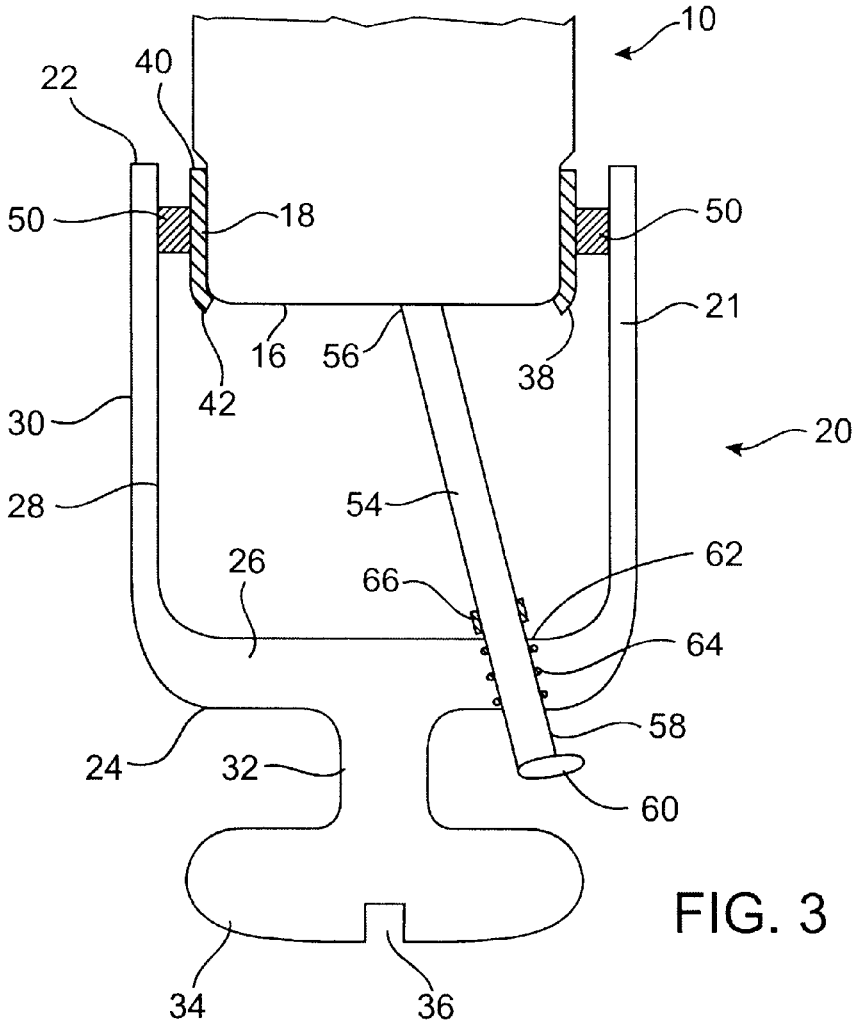
FIG. 3 is a cross sectional view of the oil filter removal device taken along line 3—3 of FIG. 2 also showing the oil filter canister engaged thereby.

Now also referring to FIGS. 2 and 3, an oil filter removal and installation device is generally designated by numeral 20 to be used in combination with canister 10. Device 20 has a wall 21 which is generally annular and thus defines an open end 22. A closed end 24 is defined by a bottom 26 such that device 20 is generally in the shape of a receptacle. An inner surface 28 and outer surface 30 are formed along bottom 26 and wall 21.

A protrusion 32 extends from outer surface 30 of bottom 26 in a direction distal to open end 22 and is substantially centrally located on said bottom 26. A first member 34 having a substantially longitudinal shape is attached to protrusion 32 in a substantially perpendicular fashion at an end distal to bottom 26. First member 34 may be adapted to fit within a hand of a user in an ergonomic fashion. A user can apply force to member 34 such that a torque will in turn be applied to device 20. A cavity 36 is defined within first member 34 and is substantially axially aligned with protrusion 32. In a preferred embodiment, cavity 36 is adapted to receive a driver member located on a typical ratchet wrench (not shown) in order to apply greater torque when the situation requires.

An attaching member 38 has a front end 40 and a back end 42 with an opening 44 being axially defined therethrough. Attaching member 38 has an interior surface 46 and an exterior surface 48 wherein interior surface 46 defines opening 44. The configuration of interior surface 46 of attaching member 38 may be adapted to match the flat sides 18 of canister 10 such that the flat side 18 may be received therein in a secure yet removable fashion. In addition, back end 42 may be inwardly extended to engage second end 16 after insertion thereof into opening 44. It is to be understood that although flat sides 18 are shown and interior surface 46 is adapted to engage the same, any other configuration that is known in the art or that is yet to be developed may be adapted to be received within opening 44 and engaged by interior surface 46.

Attaching member 38 is preferably smaller in diameter than open end 22 such that attaching member 38 may be received therein. At least a binding means 50 extends from inner surface 28 and binds to exterior surface 48 such that attaching member 38 is maintained within open end 22 of device 20. In a preferred embodiment, a plurality of binding means 50 are equidistantly placed around said exterior surface 48 such that a plurality of apertures 52 are created therebetween. Thereby, as canister 10 is removed from an engine, any hot and dirty oil which leaks therefrom will travel down the outside of canister 10, through apertures 52, and be received within inner surface 28 and bottom 26 of device 20.

In certain circumstances, interior surface 46 of attaching member 38 may bind canister 10 in a secure fashion and would need a disengaging means 54. Disengaging means 54 has an anterior end 56 and a posterior end 58 wherein posterior end 58 also has an actuation member 60 thereon. Disengaging member 54 extends through a hole 62 defined by bottom 26 of device 20 from the outer surface 30 and out of inner surface 28 and is of sufficient length to reach second end 16 of canister 10. Disengaging member 54 is frictionally maintained within hole 62 and at least a rubber grommet 64 is provided thereon to engage bottom 26 around hole 62 to prohibit the leakage of fluid therethrough. In a preferred embodiment, a plurality of rubber grommets 64 may be provided thereon. When a canister is received within attaching member 38, disengaging member 54 is forced in a rearward fashion and extends out from closed end 24. An abutment 66 is provided on disengaging member 54 that is larger in diameter than hole 62 to prevent disengaging member from being extruded. In order to disengage canister 10 from attaching member 38, force is applied to actuation member 60 of disengaging means 54 which. results in forward motion thereof and causes canister 10 to be forced out of attaching member 38.

Figure 4:
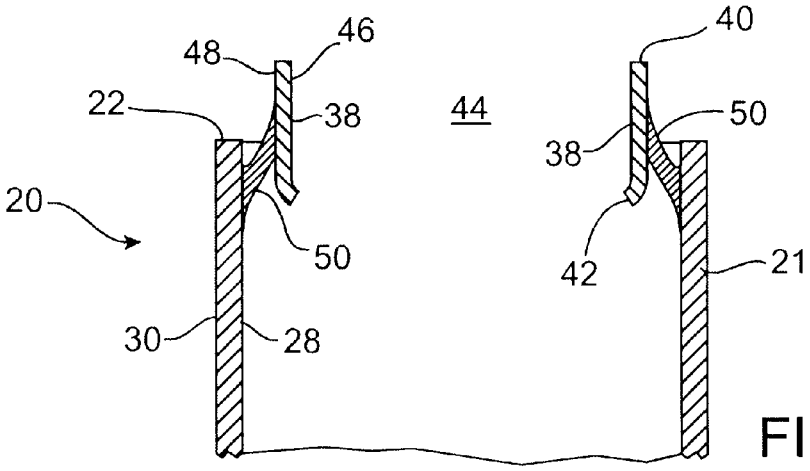
FIG. 4 is a partial sectional view of an alternate preferred embodiment of the oil filter removal and installation device.

Now referring to FIG. 4, an alternate preferred embodiment of device 20 is illustrated in partial form. In tight areas around the engine of most modem vehicles, it may be difficult to insert open end 22 of device 20 to engage a canister 10. Accordingly, binding means 50 may be adapted to extend front end 40 of attaching member 38 past wall 21 of open end 20. In such an arrangement, because attaching member 38 has a smaller diameter than wall 21 defining open end 20, attaching member 38 may fit into tighter spaces and engage canister 10 and yet allow device 20 to capture any escaping oil as illustrated in detail above.

Figure 5:
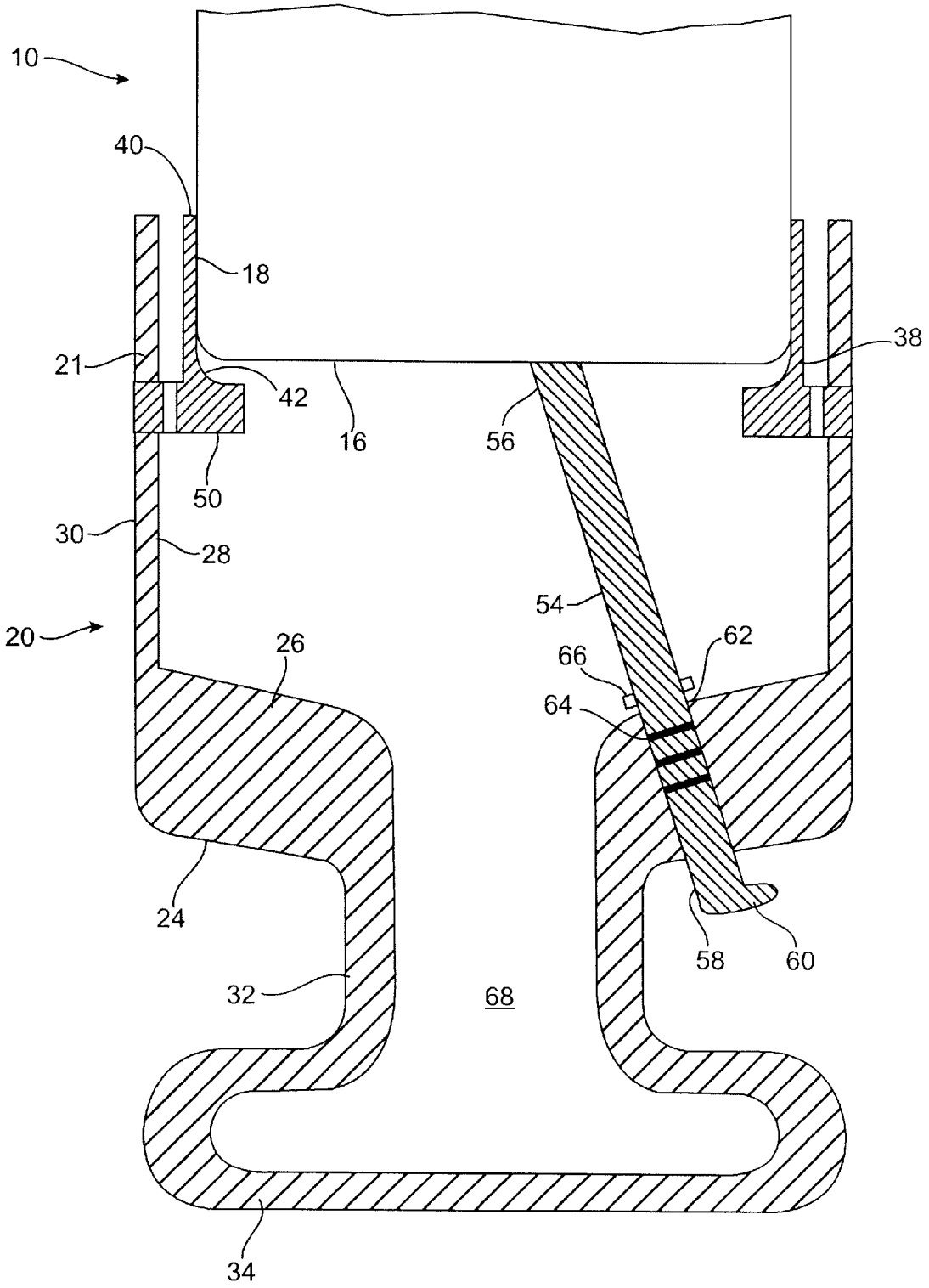
FIG. 5 is a cross sectional view of another preferred embodiment of the oil filter removal and installation device taken along line 3—3 of FIG. 2.

Now referring to FIG. 5, an alternate preferred embodiment of device 20 is therein illustrated. Inner surface 28 would now extend into protrusion 32 and first member 34 thereby defining a reservoir 68 therein. As such, more excess oil may be captured within reservoir 68 and thus the length of wall 21 may be shortened to make device 20 more compact. Furthermore, binding means 20 may extend from inner surface 28 of wall 21 and bind to back end 42 of attaching member 38. In addition, binding means 50 may also retain second end 16 of canister 10 thereon and allow better attachment of attaching member 38.

For purposes of illustration, but not limitation, device 20 may be made of any hardened plastic, metal, wood, or any other suitable rigid material that is known in the art. In addition, to strengthen portions of device 20, metal inserts (not shown) configuring to the shape defining cavity 36, attaching member 38, and binding means 50 may be used. Device 20 may be manufactured in any fashion which is known in the art but is preferably injection molded.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. A device for installing and removing an oil filter canister, comprising:

a peripherally contiguous wall defining an open end and a closed end;

a first member extending from said closed end in a direction distal to said open end and receiving a hand of a user and an application of force by said hand;

an attaching member being maintained within said open end by at least a binding means extending from said wall, and said attaching member securely yet removably binding to the canister;

a protrusion extends from said closed end of said device in a direction that is distal to said open end and attaches to said first member in a perpendicular fashion;

a reservoir being formed within said protrusion and said first member for capturing liquid therein;

whereby, upon removal of the canister any escaping oil is captured within said wall and said closed end.

2. The device of claim 1, wherein said attaching member further comprises a contiguous barrier which defines an opening therein which is substantially axially aligned with said open end.

3. The device of claim 2, wherein said barrier has a front end and a back end which are connected by an interior surface and an exterior surface.

4. The device of claim 3, wherein said interior surface is configured to receive the canister in a secure manner.

5. The device of claim 3, wherein said exterior surface is of smaller diameter than said wall defining said open end.

6. The device of claim 3, wherein said back end of said barrier is inwardly oriented to decrease a diameter of said opening at said back end when compared to said front end to better retain said canister therein.

7. The device of claim 3, wherein a plurality of said binding means are equidistantly spaced and extend from an inner surface of said wall and attach to said exterior surface of said barrier and define a plurality of apertures therebetween.

8. The device of claim 1, wherein said first member also defines a cavity therein that receives a torque applying tool.

9. The device of claim 8, wherein said protrusion and said first member are hollow and define a reservoir that communicates with said closed end for capturing oil.

10. The device of claim 1, wherein said first member also defines a cavity therein a receives a torque applying tool.

11. The device of claim 10, wherein said disengaging means further comprises an anterior end that contacts said canister and a posterior end that extends through a hole within said closed end in a frictional and hermetically sealed manner.

12. The device of claim 11, wherein at least a rubber grommet is placed upon said disengaging means such that said rubber grommet engages said closed end defining said hole.

13. The device of claim 11, wherein an actuation member is placed on said posterior end and an abutment is placed on said disengaging means to prevent extrusion of said disengaging means from within said hole.

14. The device of claim 3, wherein a top of said wall and said front end of said barrier are on an even plane.

15. The device of claim 3, wherein said front end of said barrier extends beyond a plane of a top of said wall.

16. A device for installation and removal or an oil filter canister, said canister having a first portion that is cylindrical and a second portion that is polygonal, comprising:

a peripherally contiguous wall defining an open end and a closed end interconnected by an inner surface and an outer surface;

a first member extending from said closed end in a direction distal to said open end and receiving a hand user;

a reservoir being formed by said first member and said inner surface of said wall;

a peripherally contiguous attaching member having an interior surface defining an opening therein and an exterior surface for attachment to said inner surface, said interior surface engages said second portion of said canister to retain said second portion within said opening;

said inner surface of said wall having a larger diameter than said exterior surface of said attaching member;

whereby, upon removal of the canister any escaping oil is captured within said reservoir defined by said inner surface, said closed end and said first member.

17. The device of claim 16, wherein a disengaging means communicates with said canister to dislodge same from within said attaching member.

18. A device for installation and removal of an oil filter canister, said canister having a first portion that is cylindrical and a second portion that has a plurality of flat sides, comprising:

a peripherally contiguous wall defining an open end and a closed end interconnected by an inner surface and an outer surface whereby said inner surface forms a reservoir therein;

a first member extending from said closed end in a direction distal to said open end and receiving a hand of a user and a force applied by said hand;

a peripherally contiguous attaching member having an interior surface defining an opening therein and an exterior surface for attachment to said inner surface of said wall by at least a binding means having an aperture therethrough, said interior surface engaging said second portion of said canister to retain said second portion within said opening;

said inner surface of said wall having a larger diameter than said exterior surface of said attaching member;

a disengaging member traveling through a hole within said closed end in a hermetically sealed fashion and being of sufficient length to communicate with said canister to dislodge said canister;

whereby, upon removal of the canister any escaping oil travels through said aperture in said binding means and is capture within said reservoir defined by said inner surface and closed end.

* * * * *